United States Patent [19]

Sibley et al.

[11] Patent Number: 4,900,366

[45] Date of Patent: Feb. 13, 1990

[54] METHOD FOR CLEANING CONTACT LENS WITH DISSOLVING ABRADANT

[75] Inventors: Murray J. Sibley, Berkeley; Rebecca F. Nite, Cupertino, both of Calif.

[73] Assignee: Pilkington Visioncare Holdings, Inc., Menlo Park, Calif.

[21] Appl. No.: 153,156

[22] Filed: Feb. 8, 1988

Related U.S. Application Data

[63] Continuation-in-part of Ser. No. 14,756, Feb. 13, 1987, abandoned.

[51] Int. Cl.[4] ..... B08B 7/00; C11D 3/04

[52] U.S. Cl. ..... 134/42; 252/89.1; 252/135; 252/DIG. 14

[58] Field of Search ..... 252/89.1, 174.21, 135, 252/174.25, DIG. 14; 134/42

[56] References Cited

U.S. PATENT DOCUMENTS

| | | | |
|---|---|---|---|
| 3,944,506 | 3/1976 | Hramchenko et al. | 252/526 |
| 3,981,826 | 9/1976 | Munro | 252/526 |
| 4,394,179 | 7/1983 | Ellis et al. | 134/7 |
| 4,588,444 | 5/1986 | Anderson | 134/2 |
| 4,655,957 | 4/1987 | Chromecek et al. | 252/174.23 |
| 4,734,222 | 3/1988 | Winterton et al. | 252/546 |

FOREIGN PATENT DOCUMENTS

| | | |
|---|---|---|
| 0095524 | 12/1983 | European Pat. Off. . |
| 2055118A | 2/1981 | United Kingdom . |

OTHER PUBLICATIONS

European Search Report EP 88 10 2092.

The Condensed Chemical Dictionary, Seventh Edition Reinhold Publishing Co., N.Y., p. 130.

CRC Handbook of Chemistry and Physics, CRC Press, Inc., Boco Ratan, Fla., 65th Ed. (1984–85), pp. B125+144.

*Primary Examiner*—Prince E. Willis

*Attorney, Agent, or Firm*—Scully, Scott, Murphy & Presser

[57] ABSTRACT

A composition is disclosed useful for cleaning hard and soft contact lenses, in which cleansing action is provided by a relatively soft abradant particulate sparingly soluble room temperature solid organic acid or inorganic salt, preferably in combination with one or more surfactants. The particulate material effectively removes deposits from the lens, and readily dissolves on the application of water.

4 Claims, No Drawings

METHOD FOR CLEANING CONTACT LENS WITH DISSOLVING ABRADANT

The present invention is a continuation in part of the U.S. patent application Ser. No. 014,756, filed Feb. 13, 1987, now abandoned and relates to the cleaning of hard and soft contact lenses.

DESCRIPTION

1. Technical Field

As is by now well known, contact lenses accumulate proteinaceous and lipid-type deposits which must be removed from the lens to promote clear vision and proper hygiene. A variety of products have been proposed for this purpose. Some are based on the action of enzymes or surfactants.

2. Prior Art

Another type of product, disclosed in U.S. Pat. No. 4,394,179, comprises small, insoluble particles which are rubbed against the lens surface to dislodge debris. Such a product runs the risk of damaging the surface of the lens over a number of successive uses, and requires extremely thorough washing of the lens to ensure that every particle has been removed from the lens before the lens is reinserted into the eye. Otherwise, irritation and even tissue damage can be inflicted on the eye.

There is thus a need for a product for removing deposits from hard and soft contact lenses which will not damage the lens and which will pose a reduced risk that unwanted irritating particles would be introduced into the eye. While facial cleansers containing dissolving abradant cleansers have been disclosed in U.S. Pat. No. 4,048,123 and U.S. Pat. No. 3,994,506, it has long been believed that such cleansers would be damaging to contact lenses, particularly soft contact lenses.

SUMMARY OF THE INVENTION

In one aspect, the present invention comprises abradant compositions for cleaning contact lenses, comprising:

as an abradant component;

an effective amount of a slightly water soluble, non-toxic physiologically acceptable room temperature solid inorganic acid having a maximum particle size of about 40 microns, especially about 10 microns and in both instances no more than about 0.01 wt.% of the particles being larger and preferably no particles being larger. In both instances (i.e., where the particles are about 40 microns or about 10 microns), smaller particles may be present, or;

an an effective amount of a slightly water soluble, non-toxic physiologically acceptable inorganic salt having a particle size less than about 210 microns, preferably not more than 105 microns;

where said inorganic acid or said inorganic salt has a hardness less than about 6 on the Mohs scale, preferably less than about 4 on the Mohs scale.

Preferably, the compositions further comprise an amount of liquid less than the amount required to dissolve at ambient temperature the entire amount of said inorganic acid or said inorganic salt.

In another aspect, the present invention comprises a composition comprising the components defined above, and further comprising one or more surfactants.

DETAILED DESCRIPTION OF THE INVENTION

As indicated, the present invention provides effective cleaning of hard and soft contact lenses and is safe to the lens and safe to the eye of the lens wearer. Other advantages will be apparent from the following description.

The lens cleaning and disinfecting regimen in accordance with the present invention is useful with any contact lenses of the hard and soft type. Hard lenses include the well-known lenses made from poly(methylmethacrylate), as well as those based on various monomers in which a substituted silicone (such as tris(trimethylsiloxy)-silyl) is connected through an alkylene bridge to an acrylic or methacrylic moiety. Soft lenses with which the present invention is useful include any of the large variety of hydrophilic homopolymers and copolymers, including those based on hydroxyethylmethacrylate alone or copolymerized with, for example, vinyl pyrrolidone, methacrylic acid, methylmethacrylate, diacetone acrylamide and the like. Examples of other suitable hydrophilic lens polymers abound in the literature and will be readily apparent to those of ordinary skill in this art. Soft lenses with which the present invention is useful also include those soft, non-hydrophilic lenses made from various modifications of silicone rubber.

The abradant component is preferably sparingly soluble in water, normally being soluble in water in an amount of less than about 30 weight percent of 40° C. and less than about 10 weight percent at 20° C. The abradant component should have a solubility in water at 20° C. of at least 0.5 weight percent, and usually at least 1 weight percent, and preferably at least about 3 weight percent. The abradant component must be non-toxic and non-irritating to the eye.

The abradant component must have a particle size such that rubbing the lens in the palm of a hand under normal finger pressure will not damage the lens. Where the abradant component comprises particles of a room temperature solid inorganic acid, such particles will have a particle size of about 40 microns, especially about 10 microns and in both instances no more than about 0.01 wt.% of the particles will be larger, but preferably, no particles will be larger. In both instances (i.e., where the room temperature solid inorganic acid particles are about 40 microns or about 10 microns) smaller particles may be present so that the particles comprising the about 40 micron particles in one instance or the about 10 micron particles in the other instance will comprise in either instance from about 98% to about 99% of the particles. Of course, any of the abradant components can be a mixture of particles having a variety of particle sizes. A particle size of less than about 210 microns (U.S. Sieve Series No. 70), preferably less than about 105 microns, and more preferably less than about 74 microns is generally satisfactory where the abradant component comprises the inorganic salt. In the more preferred embodiments, at least 99% should be about 210 microns or smaller, and preferably at least 98% is about 149 microns or smaller (and more preferably at least 98% is about 105 microns or smaller) for such inorganic salt.

The abradant component will generally have a hardness less than about 6 and preferably falling in the range of about 1.5 to about 4 on the Mohs scale. The hardness and size of the particles are both significant to the ability of the particles to remove proteinaceous and lipid material from the surface of the lens, without damaging the lens itself. The size of the particles will also affect the rapidity with which the particles dissolve upon contact with additional amounts of water when the lens is rinsed and/or stored in an appropriate solution. As indicated, however, the abradant component must be sparingly soluble in water so that the lens cleaning composition of the present invention can be prepared and stored for hours, days or weeks without the abradant component dissolving into the liquid which is present in the composition.

The most preferred room temperature solid inorganic acid abradant component useful in this invention comprises boric acid. Boric acid, as that term is used herein is intended to include grades of boric acid (e.g., $H_3BO_3$) such as boric acid impalpable NF that are available from standard commercial sources, as well as various boric acid compounds and compositions, such as mixtures of boric acid (e.g., $H_3BO_3$) with salts to change its solubility in water (i.e., decrease or increase its solubility), such salts comprising alkali metal salts including alkali halides, sulfates or borates. For example, the water solubility of boric acid ($H_3BO_3$) is decreased by sodium chloride and lithium chloride and is increased by sodium sulfate, potassium chloride and potassium sulfate. Basic anions and other nucleophiles such as fluorides and borates increase the solubility of boric acid ($H_3BO_3$). By adding such salts to the boric acid, the degree of solubility can be controlled and consequently, the amount of particles in the boric acid solution can be controlled, i.e., increased or decreased. Boric acid suitable for the present invention (including mixtures thereof with such salts) is further described in Kirk-Othmer, *Encyclopedia of Chemical Technology, Third Edition;* Vol. 4, pp. 71–80, 108–110; all of which is incorporated herein by reference.

The preferred inorganic salt component useful in this invention is sodium borate, by which is meant any of the salts of sodium and borate (e.g., boric acid or boric acid anhydride). The most preferred sodium borate is borax, that is, sodium borate decahydrate. Satisfactory borax products useful in the practice of this invention include those known as "NF Grade" borax in the powdered or impalpable grades available commercially from U.S. Borax Company.

The abradant component should be present in undissolved form in the cleaning composition in an amount effective to perform the desired lens cleaning function. The amount will generally be in a range up to about 50% by weight of the composition. Lesser amounts, i.e., less than 30% or even less than 20% can also be employed, provided that the amount of water and the other components present are adjusted accordingly so that the abradant component does not dissolve upon standing. Generally, the undissolved abradant should comprise at least 1, and preferably at least 5, weight percent of the composition.

The composition of the present invention also preferably includes a surfactant component, by which is meant one or more surfactants. Although the surfactant component strictly speaking is not required for the abradant component to perform its function, the surfactant aids in removal of lens deposits. In addition, it has been surprisingly found that the combination of a surfactant component with the abrandant component works better than either component used alone. The surfactant component should comprise one or more compounds capable of solubilizing one or more of the types of soilants known as lipid material, mucins, and proteinaceous material, thereby aiding in the removal of such soilants from the lens surface. The surfactant component should have an HLB value of about 7 to about 18.

Among different anionic surfactants usable in the invention, particular mention may be made of the alkaline salts, ammonium salts, amine salts or amino alcohol salts of the following compounds:

the alkylsulfates, alkylether sulfates, alkylamide sulfates and ether sulfates, alkylarylpolyether sulfates, monoglyceride sulfates, the alkylsulfonates, alkyl amide sulfonates, alkylaryl sulfonates, alpha-olefine sulfonates, the alkyl sulfosuccinates, alkyl ether sulfosuccinates, alkylamide sulfosuccinates, the alkylsulfosuccinamates, the alkyl sulfoacetates, the alkylpolyglycerol carboxylates, the alkyl phosphates, alkylether phosphates, the alkylsarcosinates, alkylisethionates, alkyl taurates, the alkyl radical of all these compounds being a carbon chain of 12 to 18 atoms of carbon.

Useful anionic surfactants can be represented by the formula $ROSO_3M$, $ROC(O)CH_2SO_3M$ or $RO(C_2H_4O)_xSO_3M$ wherein R is alkyl or alkenyl or about 10 to about 20 carbon atoms, x is 1 to 10, and M is a water-soluble cation such as ammonium, sodium, potassium, or triethanolamine. The alkyl ether sulfates useful in the present invention include condensation products of ethylene oxide and monohydric alcohols having about 10 to about 20 carbon atoms. Preferably, R has 14 to 18 carbon atoms in the alkyl sulfates, alkyl ether sulfates, and alkyl sulfoacetates. The alcohols can be derived from fats, such a coconut oil or tallow, or can be synthetic. Such alcohols are reacted with 1 to 10, and preferably 3, moles of ethylene oxide and the resulting mixture of molecular species is sulfated and neutralized.

Other examples of anionic surfactants include the reaction products of fatty acids esterified with, e.g., isethionic acid and neutralized with sodium hydroxide, where the fatty acids are derived, for instance, from coconut oil; or sodium or potassium salts of fatty acid amides of methyl tauride in which the fatty acids, for example, are derived from coconut oil. Still other anionic surfactants include those designated as succinamates. This group includes such surfactants as disodium N-octadecylsulfosuccinamate; tetra sodium N-(1,2-dicarboxyethyl)-N-octadecylsulfosuccinamate; and dioctyl esters of sodium sulfosuccinic acid. Other suitable anionic surfactants include olefinsulfonates having about 12–24 carbon atoms.

In addition, one or more nonionic surfactants are also useful. Useful nonionic surfactants include those having the formula:

$$(Acyl)—(OAlk)_nOH$$

wherein (Acyl) is derived from a $C_{12}$–$C_{20}$ fatty acid such as oleic, lauric, or palmitic acid, and (OAlk) is a polyoxyakylenemoiety in which each alkylene unit "Alk" has the formula $C_2H_4$ or $C_3H_6$ and n is 2 to 60. Other satisfactory nonionic surfactants include those having the formula $(Alk)—(AAlk)_nOH$ wherein (Alk) is a saturated or a monosaturated alkyl or alkylene moiety having 10–20 carbon atoms and (OAlk) and n are as defined above. Further examples of satisfactory nonionic surfactants include those generically known as "polysorbate", which can be generally defined as various mixtures of $C_{12}$-$C_{20}$ fatty acid esters of sorbitol, and sorbitol anhydride condensed with 4–20 moles of ethylene oxide.

One group of preferred surfactants are the non-ionic surfactants known as hydroxyalkylated surfactants and polyoxyalkylated surfactants. Extremely effective at very low concentrations are N-hydroxyalkylated carboximides of fatty acids of from 10–18 carbon atoms, preferably of from 12–14 carbon atoms and having no or one site of olefinic unsaturation. There will normally be up to two hydroxyalkyl groups of from 2–3 carbon atoms, which may be same or different.

The polyoxyalkylated non-ionic surfactants may comprise solely a chain of 2 to 60 polyoxyalkylene groups of from 2–3 carbon atoms each, or may have such a polyoxyalkylene chain bonded directly or indirectly to an aliphatic chain of from 10–10 carbon atoms. The polyoxyalkylene chain may be a homo-oligomer or co-oligomer, with the homo-oligomer normally being ethyleneoxy groups and the co-oligomer being a random or block co-oligomer of ethyleneoxy and propyleneoxy groups.

Another satisfactory nonionic surfactant is polyalkyleneoxy modified silicone, which is a silicone modified with polyalkyleneoxy groups wherein each alkylene group contains 2 or 3 carbon atoms. Illustrative compositions are described in U.S. Pat. Nos. 2,834,748 and 3,505,377. The compositions employed in this invention have a viscosity at 25° C. of from about 900–1600 cs, more usually from about 100–1500 cs. The specific gravity at 25° C. will be about 20–22, more usually about 21 dynes per cm. The surface tension at a concentration of 1% in water 25° C. will generally be from about 25–28, more usually from about 26–27 dynes per cm. At a concentration of 1 weight percent in water, the cloud point will be below 50° C. usually below about 40° C. and will usually be above about 30° C. The silicone polymer will usualy be a block copolymer with the polyalkyleneoxy polymer.

The siloxy units are preferably dimethylsiloxy units while the alkylenoxy units are preferably ethyleneoxy or 1,2-propyleneoxy units. The number ratio of ethyleneoxy units to other units (dimethylsiloxy and propyleneoxy) will be at least 0.5:1 and generally not more than about 5:1, usually not more than about 2:1. The molecular weight of the copolymer will generally be from about 4,000 to 10,000, preferably about 5,000 to 7,500. The terminal groups of the polymer will usually be a $C_1$–$C_3$ alkylsiloxy group at one end and alkoxy group of from 1 to 6 carbon atoms at the other end.

The preferred siloxane-polyoxyalkylene copolymers employed in this invention will have the following formula:

$$TSi(O(SiMe_2O)_x(C_nH_{2n}O)_yY_3$$

wherein:

each of the chains may be the same or different, the values given for x and y being the average over the entire composition;

x is a number in the range of 3 to 10, usually 4 to 8;

y is a number in the range of 20 to 50, usually 25 to 40;

n is an integer of from 2 to 3;

T is alkyl of from 1 to 3 carbon atoms, usually methyl; and,

Y is alkyl of from 1 to 6 carbon atoms, usually 3 to 4 carbon atoms.

More preferably, the siloxane-polyoxyalkylene block copolymer will have the following formula:

$$TSi(O(SiMe_2O)_x(C_2H_4O)_a(C_3H_6O)_bY)_3$$

wherein:

each of the chains may be the same or different, the values given x, a and b being the average over the entire composition;

x is a number in the range of 4 to 8, usually 5 to 7;

a is a number in the range of 15 to 30, usually 15 to 25;

b is a number in the range of 10 to 20, usually 12 to 16; and, the other symbols have been defined previously.

Another satisfactory surfactant is a fatty acid amide or nitrogen analog thereof, of an amine which is at least disubstituted by from 2 to 3 aliphatic groups, two of the groups having oxygen containing substituents such as oxy or carbonyl, particularly non-oxo carbonyl. For the most part, the fatty acid amides which are employed in the subject invention will have the following formula:

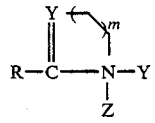

wherein:

R is a saturated or mono-saturated alkyl or alkylene group, preferably saturated, of from 9 to 18, preferably 9 to 13, usually 11 carbon atoms;

x is oxygen or nitrogen;

m is 0 when X is oxygen and 1 when X is nitrogen, wherein the nitrogen to which Y and Z is attached is positive;

Y is an aliphatically saturated group of from 2 to 4 carbon atoms and from 1 to 3 oxygen atoms as the only heteroatoms, the oxygen atoms being present as hydroxy or other, there being at least two carbon atoms between heteroatoms, or carboxy, with the proviso that when oxygen is present as carboxy, the carbonyl group may be present as the acid or its physiologically acceptable salts, e.g., sodium; and Z is a saturated aliphatic group of two to three, usually two carbon atoms and from 1 to 2 oxygen atoms as the only heteroatoms, which may be present as hydroxy, ether, or carbonyl and the carbonyl group may be present as the acid or a physiologically acceptable salt.

When the fatty acid amide is of the formula when m is 0, it will for the most part have the formula:

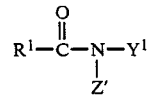

wherein:

$R^1$ comes within the definition of R;

$Y^1$ and $Z^1$ are the same or different and are hydroxyalkyl of from 2 to 3 carbon atoms, the oxygen and nitrogen being separated by at least 2 carbon atoms.

When the fatty acid amide is of the formula when m is 1, it preferably has the following formula:

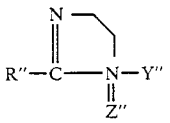

wherein:

R″ comes within the definition of R;

Y″ is an aliphatically saturated carboxylic acid group of from 2 to 4 carbon atoms having from 0 to 1 ethereal oxygen and free of other heterofunctionalities;

Z″ is an aliphatically saturated carboxylic acid group of from 2 to 3 carbon atoms, and free of other heterofunctionalities;

wherein the acids and quarternary ammonium groups have physiologically acceptable cations, e.g., zwitterion, proton, or alkali metal (preferably sodium).

Of particular interest are compounds of the following formula:

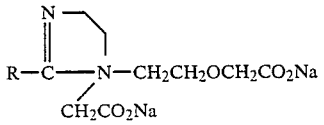

wherein R is of from 9–13 carbon atoms, usually 11 carbon atoms.

The imidazoline compounds may be prepared in accordance with the teaching of U.S. Pat. No. 2,586,496.

Of particular interest are the lauramide of diethanolamine and 2-undecyl-3-carboxymethyl-3-(2′-(carboxymethoxy)-ethyl)-1-imidazoline, usually as the disodio hydroxy salt.

Particularly, in combination with the diethanolamine amide or homolog, small amounts of organic salts of diethanolamine or its homologs may be used, particularly salts of fatty acids of from 16 to 18 carbon atoms having from 0 to 1 site of ethylenic unsaturation, e.g., oleate salts or alkylbenzenesulfphonate salts, wherein the alkyl group is straight or branched chain, and is normally of from 6 to 18, more usually from 8 to 14 carbon atoms. When present, the salts will generally be used in a mole ratio of salt to amide in the range of 1:2–4, more usually 1:3. That is, from about 20 to 33, usually 25 mole %, of the amide is replaced with the salt.

Satisfactory surfactants are commercially available under a wide variety of trade names, such as "Pluronic", "Steol", "Miranol", "Tween", "Igepal", "Brij", and "Myrj". These surfactants include those with the following general formulas:

"Pluronic": Poly oxyalkylene compounds of the formula $$HO(CH_2CH_2O)_x(CH(CH_3)CH_2O)_y(CH_2CH_2O)_zH$$

wherein the sum of (x+y+z) is 2–60.

"Steol": Alkali (e.g., sodium or ammonium) salt of the sulfate ester of the polyethylene glycol ether of lauryl alcohol, the ester having the formula $$CH_3(CH_2)_{10}CH_2(OCH_2CH_2)_{1-12}OSO_3.$$

"Miranol": Amphoteric surfactants having the formula $$RC(O)NHCH_2CH_2N(R_1)_{1-2}(CH_2)_{1-2}COOH$$

wherein RC(O) is the acyl radical of coconut, lauric, stearic, caprylic, or oleic acid; and $R_1$ is $—CH_2CH_2OH$, $—CH_2CH_2OCH_2CH_2COOH$, an alkali salt thereof, or $—CH_2COOH$ or an alkali salt thereof.

"Tween":

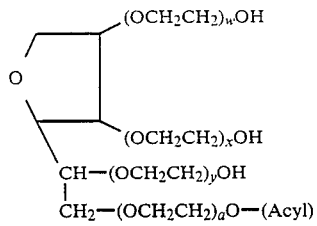

wherein (a+w+x+y) is 4–20; and (Acyl) is an acyl group containing 10–20 carbon atoms which is saturated or mono-saturated.

"Igepal": Ethoxylated alkyl phenol having the general formula $$C_9H_{19}C_6H_4(OCH_2CH_2)_nOH$$

wherein n is 4–50.

"Brij": Polyethylene glycol ether of stearyl, oleyl, cetyl, or lauryl alcohol, having the general formula $$R—(OCH_2CH_2)_nOH$$

wherein n is 2–30 and R is the de-hydroxylated residue of the alcohol.

"Myrj": Polyethylene glycol ester of stearic acid, having the general formula $$R—(OCH_2CH_2)_nOH$$

wherein n is 2–60 and R is the stearoyl acyl radical.

The surfactant component can also comprise an ampholytic detergent, which will normally be a betaine having an aliphatic carbon chain bonded to nitrogen of from about 10–18 carbon atoms, preferably from about 10–14 carbon atoms.

The surfactant component is generally present in an amount effective to aid in the removal of proteinaceous and/or lipid materials (preferably both types of material) from the contact lens surface. Amounts of about 0.1 to about 70 weight percent, preferably about 1 to about 60 weight percent and more preferably about 10 to about 50 weight percent, of the composition are satisfactory.

Individual surfactants or combinations of surfactants may be employed with the total concentration being in the indicated range. The above description is meant to be illustrative and not limiting; other examples of satisfactory surfactants meeting the objective described herein will be apparent to the skilled practitioner and are intended to be within the scope of the present invention.

The composition of the present invention should also contain a small amount of liquid, to aid in spreading the composition onto the lens surface during the cleaning operation. Amounts as low as about 3 weight percent of the composition, more usually at least about 5 weight percent of the composition, can be present. Water is the preferred liquid, but it should be recognized that if the surfactant component is liquid (even a viscous liquid)

which can be spread onto the lens surface then water is not necessary. The liquid can also comprise up to about 50 or even 75 weight percent of the composition. As noted herein, the amount of water and/or other liquid present will depend on the amount of the abradant component present, as the amount of liquid must be less than that which will completely dissolve the abradant content of the composition. In other words, there must be sufficient abradant component with respect to the liquid content so that the composition is super-saturated as to the abradant.

The compositions useful in the present invention can range in consistency from a slurry having approximately the consistency of water, to a cream or paste. To adjust the viscosity to the desired thickness, the relative amounts of liquid (e.g., water), surfactant and abradant component can be adjusted accordingly. Alternatively, the composition can also contain one or more additives in an amount effective to adjust the viscosity so that it can be applied smoothly to the lens and will remain in contact with the lens during the rubbing operation rather than simply running off like water. Satisfactory thickeners for this purpose include such polymers as poloxyethylene, guar gum, methyl cellulose, methylhydroxypropyl cellulose, polypropylhydroxyethyl cellulose, locust bean gum, hydroxypropyl guar gum, hydroxyethyl cellulose, hydroxypropyl cellulose and starch derivatives such as hydroxyethylamylose. The amount of the thickener will generally be in the range of about 0.1 to about 20 weight percent, depending on the desired consistency of the final product in accordance with the objectives described herein.

Opthalmologically acceptable buffers, while not essential in this composition if borax is the abradant component, can be added to achieve the desired pH which is generally in the range of 5–10, preferably from about 7–10. Illustrative buffers include borate, phosphate, citrate, carbonate and lactate, although other physiologically acceptable buffers may be employed. The buffer concentration will generally be from about 0.05 to 0.5 weight percent, normally being about 0.1 weight percent.

The compositions useful in the present invention can readily be prepared by mixing the indicated ingredients with agitation. The additives can be added incrementally, preferably while maintaining an excess of the abradant component to avoid the undesired dissolution of that component. In best practice the composition after preparation is then sterilized, to ensure that no contamination introduced during formulation results in microbial growth in the composition. The composition after preparation is filled into appropriate plastic bottles and sterilized by gamma radiation of about 2.5 megarads.

It will be appreciated that the composition of this invention can also be prepared asceptically by using ingredients which have been sterilized prior to incorporation into the final product and by formulating the ingredients under sterile conditions.

Another aspect of the present invention is that the composition can be sterilized by autoclaving it in a sealed chamber, for instance, at a sterilizing temperature on the order of 100°–130° C., at a pressure from atmospheric to about 20 psi, and for about 10–60 minutes, without loss of the desired particle size distribution or loss of the material to dissolution. Specifically, the composition is continuously stirred while it is being sterilized, while it is cooling back to ambient temperature, and for at least about 5 hours after it returns to ambient temperature. In addition, the composition is cooled from sterilizing temperature to ambient temperature under controlled gradual cooling conditions which permit reprecipitation of a large number of nuclei. For example, cooling the composition steadily from 121° C. to 25° C. over a period not less than 30 minutes, while continuously stirring as described above, permits retention of the desired small particle size distribution described above. The conditions permit the composition to be sterilized under autoclaving conditions without undergoing any loss of the desired particle size characteristics of the composition.

The present invention can be used by simply depositing a small amount (0.1–3 ml) thereof onto the surface of the lens to be cleaned, and then rubbing the lens between the fingers or in the palm of a hand, for an effective time such as 10–30 seconds. The abradant component particles help dislodge lens soilants from the lens surface through the rubbing action. The lens is then rinsed thoroughly, preferably with a commercially available saline solution. The rinsing step causes the abradant component particles to dissolve rapidly, and washes the composition off the lens surface as noted herein, especially if the rinsing solution contains an ophthalmologically acceptable additive to increase the solubility of the abradant component, such as potassium chloride or nucleophiles (borate and fluoride) where boric acid ($H_3BO_3$) is the abradant component. Such additives are more fully described in Kirk-Othmer, supra. The lens can be immediately reinserted into the eye, without fear that undissolved particles will remain which will irritate or damage the eye tissues.

Alternatively, the cleaning step described herein can be performed at the end of the day, following which the lens is placed in a suitable storage solution overnight. The user can be very confident that any residual abradant particles will dissolve into the storage solution and will not cause discomfort when the lens is reinserted into the eye the next day.

It is a further advantage that in the preferred embodiments employing borax, the borate anion formed by dissolution into the storage solution is completely compatible with the other components of that solution. The use of borax also means that one need not add a preservative to the composition (although such an additive remains optional). In addition, the borate anion formed by the borax helps maintain the pH at an alkaline level in use on the lens surface, thereby assisting in the removal of proteinaceous material from the lens.

The invention will be further illustrated in the following examples:

EXAMPLE 1

A composition suitable for cleaning hard and soft contact lenses was prepared by thoroughly mixing together the following components in the indicated amounts.

| Components | Amount (wt. %) |
|---|---|
| Purified water | 45.8 |
| Steol 4N (28%) (Sodium lauryl ether sulfate surfactant) | 20.0 |
| Organosilicone L-720 (Nonionic surfactant, Union Carbide) | 1.0 |
| Cab-O-Sperse 143 (Colloidal fumed silica 17%) | 10.0 |

-continued

| Components | Amount (wt. %) |
|---|---|
| Sodium chloride, USP | 6.0 |
| Boric acid impalpable NF | 15.0 |
| Arlacel 165 | 2.2 |
| (Glycerol and polyoxyethylene glycol stearate) | |

The resulting composition was a suspension, which when shaken became an effective contact lens cleaner.

EXAMPLE 2

A composition suitable for cleaning hard and soft contact lenses was prepared by thoroughly mixing together the following components in the indicated amounts.

| Components | Amount (wt. %) |
|---|---|
| Organosilicone L-720 | 1.0 |
| (Nonionic surfactant, Union Carbide) | |
| MYRJ 52 (Nonionic surfactant) | 1.0 |
| Steol 4N | 9.0 |
| (Sodium lauryl ether sulfate surfactant) | |
| Hydroxyethyl cellulose (viscosity builder) | 0.4 |
| Borax impalpable NF (abradant) | 33.0 |
| Purified water | 55.6 |

The resulting composition was a suspension, which when shaken became an effective contact lens cleaner.

What is claimed is:

1. The method of removing surface deposits from a contact lens comprising (a) rubbing the lens surface with a composition that comprises an effective amount of particles of a water soluble non-toxic physiologically acceptable inorganic abradant component where said abradant is boric acid or borate salts or mixtures thereof soluble in water in an amount less than about 30 weight percent at 40° C. and less than about 10 weight percent at 20° C. having a particle size from about 10 to less than about 210 microns where at least 98 percent are about 105 microns or smaller and a hardness up about 6 (Mohs); said composition also comprising a surfactant component and an amount of liquid less than that required to dissolve at 25° C. the entire amount of said abrandant; and then (b) removing said composition and removed deposits from the lens surface.

2. The method of claim 1, wherein said abradant component has a particle size of about 40 microns where no more than 0.01 weight percent are larger.

3. The method of claim 1 wherein said abradant component has a particle size of about 10 microns where no more than 0.01 weight percent are larger.

4. The method of claim 1 wherein said abradant component has a particle size less than about 149 microns, at least about 98% of the particles being less than about 105 microns in size.

* * * * *